US005451150A

United States Patent [19]

Arbogast et al.

[11] Patent Number: 5,451,150

[45] Date of Patent: Sep. 19, 1995

[54] SICKLELESS INTERNAL GEAR PUMP WITH CROSS-SECTIONALLY MUSHROOM-SHAPED SEALING ELEMENTS INSERTED IN THE TOOTH HEAD

[75] Inventors: Franz Arbogast; Peter Peiz, both of Heidenheim, Germany

[73] Assignee: J.M. Voith GmbH, Heidenheim, Germany

[21] Appl. No.: 163,033

[22] Filed: Dec. 6, 1993

[30] Foreign Application Priority Data

Jan. 18, 1993 [DE] Germany ..... 43 01 104.7

[51] Int. Cl.[6] ..... F04C 2/10; F04C 15/00

[52] U.S. Cl. ..... 418/116; 418/124; 418/168

[58] Field of Search ..... 418/112, 123–125, 418/166–168, 171, 116

[56] References Cited

U.S. PATENT DOCUMENTS

| | | | |
|---|---|---|---|
| 726,896 | 5/1903 | Franzen | 418/167 |
| 748,348 | 12/1903 | Cooley | 418/168 |
| 2,866,417 | 12/1958 | Nubling | 418/114 |
| 3,429,269 | 2/1969 | Walter | 418/171 |
| 3,758,243 | 9/1973 | Fox, Jr. | 418/124 |
| 5,135,371 | 8/1992 | Arbogast | 418/124 |

FOREIGN PATENT DOCUMENTS

| | | | |
|---|---|---|---|
| 3633330 | 4/1988 | Germany | 418/168 |
| 4104397 | 9/1991 | Germany . | |
| 4140293 | 6/1993 | Germany . | |

OTHER PUBLICATIONS

U.S. application Ser. No. 07/988,039, Peiz, Filed Dec. 7, 1992.

*Primary Examiner*—John J. Vrablik
*Attorney, Agent, or Firm*—Baker & Daniels

[57] ABSTRACT

The invention relates to a sickleless internal gear pump with an internally toothed ring gear and a pinion meshing with the ring gear. The pinion and ring gear are rotatably mounted in a housing having a suction port and a pressure port. The ring gear includes radial ports for the medium to be pumped. The tooth heads of the ring gear or the tooth heads of the pinion have a profile groove into which a plurality of sealing elements are respectively inserted. The sealing elements are able to slide on the radially opposite tooth of the pinion or ring gear. The invention is characterized by a profile groove, viewed in axially perpendicular section, which has no ports. The individual sealing elements are provided with a channel establishing a fluid connection between the interior of the profile groove and the sealing face of the sealing element. The channel, viewed in the direction of rotation of the pinion, is enveloped by the material of the sealing element.

7 Claims, 2 Drawing Sheets

E
K
R1
30'
31
b
R2
Z
F2
32
F1
30
34
14
17
Y
X'
S
D
30'
30
30"
30
TP
12
20
"A"
7
10
13
4
14
5
6
17

SICKLELESS INTERNAL GEAR PUMP WITH CROSS-SECTIONALLY MUSHROOM-SHAPED SEALING ELEMENTS INSERTED IN THE TOOTH HEAD

BACKGROUND OF THE INVENTION

1. Field of the Invention

The present invention relates to a sickleless internal gear pump with cross-sectionally mushroom-shaped sealing elements inserted in the tooth heads, for generation of high pressure.

2. Description of the Related Art

The following prior art has been published:

DE-A-4 104 397

DE-A-4 140 293

U.S. Pat. No. 3,429,269

U.S. Pat. No. 2,866,417.

With the sickleless internal gear pump known from DE-A-4 104 397, only a line seal is created in the area of pressure buildup on the tooth heads, in keeping with the geometric shape of the sealing elements. In case of unfavorable conditions due to tolerance variations, spacing changes or changes of the gear outside diameter, as the case may be, this results in a lack of tightness of the internal gear pump.

DE-A-4 140 293 describes a radially movable sealing element which, without causing excessive manufacturing expense, quite considerably improves the sealing effect in the pressure buildup between opposite tooth heads of the gears, due to the shaping. The contour of the sealing element, for one, and the complementary design of the sealing element and the profile groove in the tooth head, for another, entail several problems, though. Namely, it is unfavorable that, as upon passing dead center the entire system pressure, i.e., the working pressure generated by the pump, acts on the sealing element. For purposes of sealing, a much lower pressure would be sufficient. The high system pressure leads to excessive sealing element wear.

The problem underlying the present invention is to provide an internal gear pump in such a way that the entire system pressure will not be utilized for sealing purposes, and a considerably lower pressure is sufficient for sealing purposes.

SUMMARY OF THE INVENTION

The present invention provides an individual sealing element which receives, prior to reaching dead center, the pressure necessary for bearing down on the conjugated tooth head. Upon passage of dead center, however, a pressure less than the entire system pressure, i.e., the working pressure generated by the pump, acts on the sealing element.

At the same time, due to the special design of the sealing element, the creation of a minimal gap between pinion head and ring gear head is ensured. This allows improving the volumetric efficiency, which, in turn, results in making the internal gear pump usable also for higher pressures. Moreover, the extensive and complicated profile grinding of the hollow head shape is dispensable in manufacturing the ring gear, since the sealing elements can be made separately thereof.

BRIEF DESCRIPTION OF THE DRAWINGS

The invention will be more fully explained with the aid of the drawing, which shows in FIG. 1, a cross-section of a sickleless internal gear pump in the area of the two gears.

DETAILED DESCRIPTION OF THE INVENTION

Figures 1, 2, 3, 4:
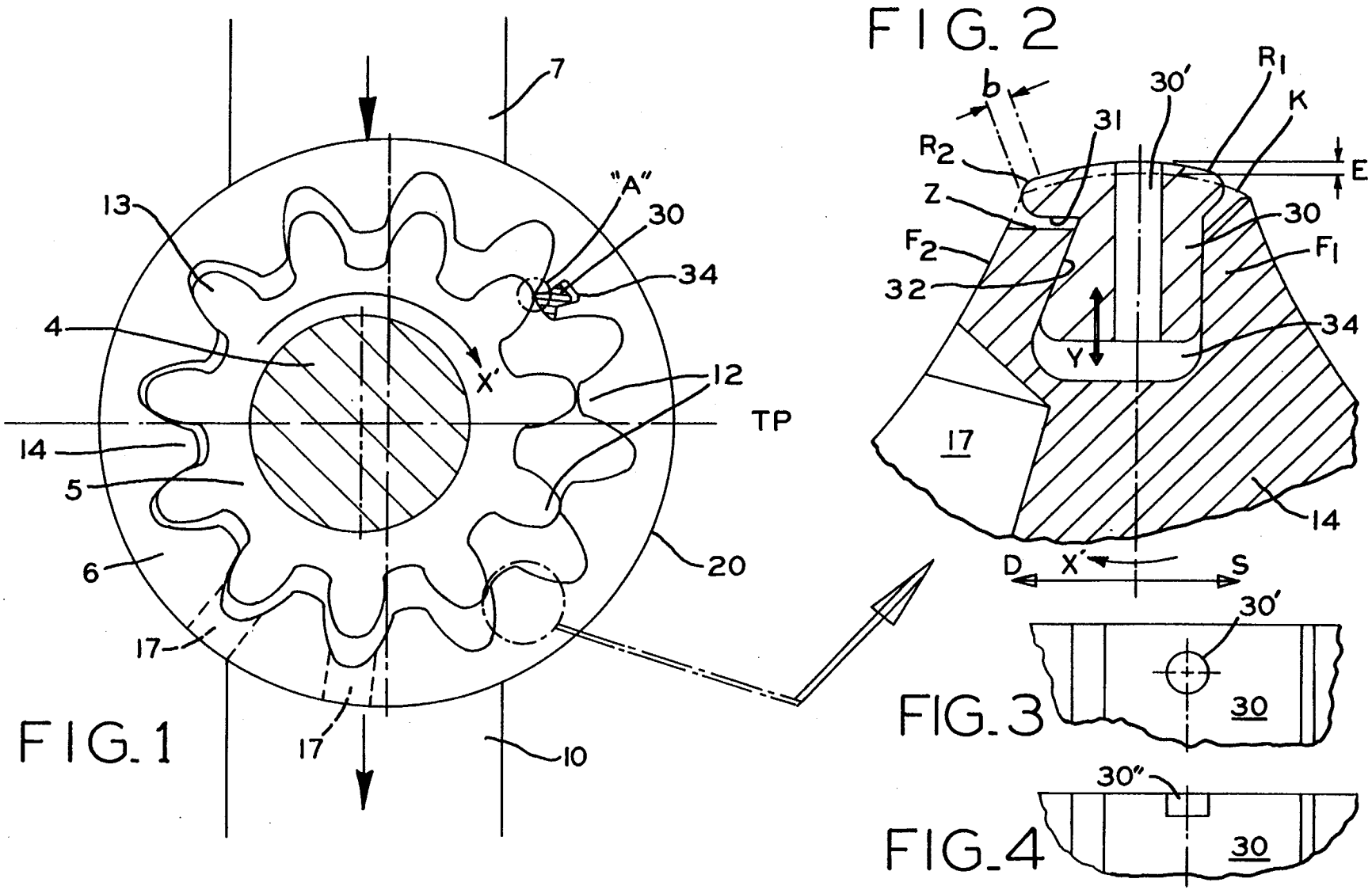
FIG. 2, an embodiment of a radially movable, cross-sectionally mushroom-shaped sealing element in conjunction with its mounting in the tooth head of a ring gear.
FIG. 3, a plan view of a sealing element according to FIG. 2, with the partial pressure which is effective on the backside of the sealing element being controlled by way of bores provided along the sealing element.
FIG. 4, a plan view of a sealing element relative to FIG. 2, with the partial pressure which is effective on the backside of the sealing element being controlled by way of one or more grooves machined axially in the end face.

FIG. 1 shows in cross section a sickleless, head-sealing and backlash-involving internal gear pump sealing always with one flank, and at that, in the area of a housing center part followed—viewed in axial direction—by further housing parts. An externally toothed pinion 5 fastened to a pinion shaft 4 meshes with an internally toothed ring gear 6. The teeth 12 of the pinion 5 and of the ring gear 6 have an axial width which is greater than the pitch circle of the pinion. The pinion 5 and ring gear 6 are not coaxial, but installed eccentrically to each other. Furthermore, the pinion 5 has one tooth fewer than the ring gear 6, so that the outside of a tooth head 13 on the pinion 5 always makes contact with the inside of a tooth head 14 on the ring gear 6. Also depicted is a suction port 7 in the zone where the teeth on the pinion 5 respectively on the ring gear 6 separate while rotating in the direction of arrow X. Following the suction port in the internal cavity of the housing center part in which the ring gear 6 and pinion 5 are installed, in axial direction to the adjacent housing parts, is a suction pocket that extends across part of the shell surface 20 of the ring gear 6. Originating as well from a pressure pocket extending over a peripheral area on the ring gear 6 on the opposite side of the pump is a pressure port 10. The influx of pressure medium to the pump interior, i.e., to the tooth spaces in the pinion 5 and ring gear 6 effecting the pumping of the pressure medium, occurs through radial ports (radial bores) 17 in the ring gear 6 (FIG. 2 and two of which are shown in FIG. 1). Ports 17 originate from the shell surface 20 and empty in the tooth bottom of the ring gear 6.

Figure 5:
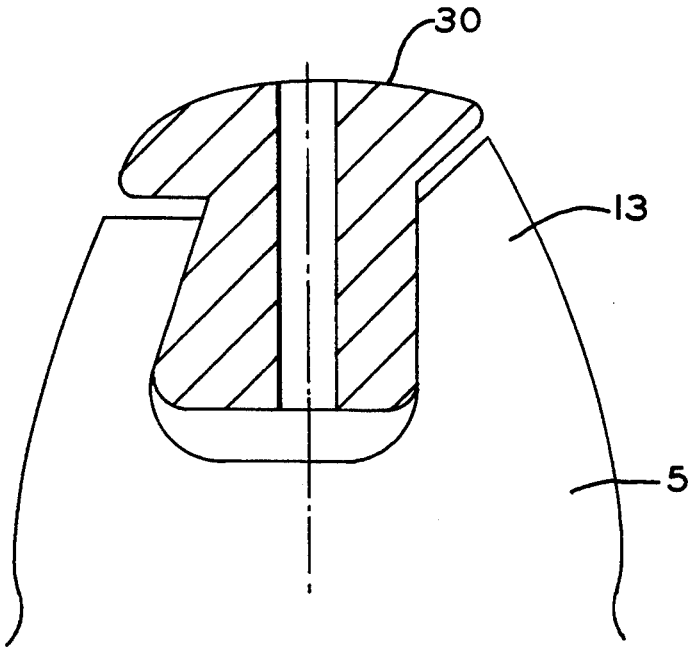
FIG. 5 is an enlarged sectional view of one of the pinion teeth showing a sealing element therein.

According to the present invention, radially movable (arrow Y) cross-sectionally mushroom-shaped sealing elements 30 are inserted in tooth heads 14 of ring gear 6, and are specially designed and installed, or held, in a complementary profile groove 34 formed in tooth head 14. If desired, sealing elements 30 could be provided in pinion teeth 13, as shown in FIG. 5.

FIG. 2 shows a section of the ring gear 6 in the area of a tooth head 14. Viewed across the periphery of the ring gear 6, the ports (radial bores) 17 which are provided for the influx of pressure medium to the gear pump interior are machined in the tooth spaces. While now, in the design according to the prior art, these ports 17 are cut into the profile groove 34 for the sealing elements 30 and extend to a flank of the tooth head, thus allowing the pressure prevailing in the leading tooth space to always act on the backside of the sealing element 30, the ports 17 now no longer cut into the profile grooves 34.

Owing to this design change, it is thus (in terms of manufacturing engineering) no longer necessary to deburr the point of cutting between the ports 17 and the profile grooves 34; this was relatively complicated, i.e., expensive, in view of the somewhat complex space conditions.

Furthermore, the design of the present invention also has functional advantages. With a design according to the prior art, the (contact) pressure effective on the backside of the sealing element 30 is always as high as the pressure in the leading tooth space (thereby forcing the sealing element outward with the force matching the system pressure, in the area of reversal from the suction side to the pressure side of the pump), the pressure effective on the sealing element 30, due to the design change, is only a partial pressure. This partial pressure effective on the backside of the sealing element can advantageously be built up and controlled by means of bores 30′ (FIGS. 2 and 3) provided along the sealing elements 30 or by means of grooves 30″ (FIG. 4) machined in the end face(s), thereby reducing ultimately the force with which the sealing element 30 is pushed outward. Reduced thereby, in the final analysis, is also the Hertzian stress effective between the sealing element 30 and the pinion head, and thus also the wear.

In conjunction with the present invention of improvement—in the region of pressure buildup (after the so-called dead center TP at the transition from the suction to the pressure space (refer also to reference "A" in FIG. 1), the partial pressure also ensures that the sealing element 30 will be moved onto the pinion head and make contact there.

Viewed functionally, the following should be noted yet as regards the realization of the channels for controlling the partial pressure acting on the sealing element 30: the bores 30′ (and also the grooves 30″) connect the open space (groove space) of the profile groove 34 at the foot of the sealing element 30—viewed in direction of rotation before dead center TP between the suction space and the pressure space—with the leading tooth space. Once the dead center TP has been passed, the bores 30′ (and grooves 30″) connect the entire groove space with the tooth space following thereafter (trailing). This has the favorable effect that the sealing element receives the pressure required for contacting the conjugated tooth head before reaching dead center TP. If only the pressure from the trailing tooth space were available, no sealing element contact would be established at all, since the groove space would not be pressurized. As to the effect of the bores 30′ (respectively grooves 30″), it is in supplementary and explanatory fashion noted that upon passing the dead center TP it is not the entire system pressure, i.e., the working pressure generated by the pump, that acts on the sealing element 30, but only the partial pressure (pressure at buildup) provided by the bores 30′ (or grooves 30″).

Viewed in terms of design, the following should be noted when comparing the prior art with the present invention. The sealing element 30, viewed in terms of design or production engineering, is provided with a material tolerance E that enables a compensation for any manufacturing tolerances. As follows from the illustration relative to FIG. 2, the sealing element 30 is able to slide (arrow Y) by tolerance E in a radial direction within profile groove 34 relative to the theoretical pitch circle diameter K of tooth head 14 of ring gear 6, with the two limit positions being determined by the inside collar 31 of the mushroom cap of sealing element 30 and nonbearing tooth flank F2, for one, and by a form-fit (fixed stop) between the foot of sealing element 30 and a wall 32 of profile groove 34, for another. These constraints apply similarly to the prior art and the design of the present invention.

In an embodiment according to the prior art, a sealing element is by means of a corrugated spring always forced outward up to the contact between the foot part of the sealing element and the corresponding wall of the profile groove. The sealing element is therefore always located in a protruding position relative to the profile groove. But this now means that the theoretical pitch circle diameter necessary for a smooth operation is being reduced on the ring gear by the tolerance E on the sealing element. At the moment of first contact between the ring gear and pinion (refer to "A" in FIG. 1), this reduction now can lead to disturbances.

According to the present inventional internal gear pump, the corrugated spring is eliminated so that, once the sealing element 30 is being forced into the profile groove 34, i.e., in the tooth head 14, due to the centrifugal force, the pitch circle diameter K (FIG. 2) is greater than the theoretical pitch circle diameter. The theoretical beginning of the tooth head sealing now being situated still in the suction space (compare "A" in FIG. 1), but the sealing element 30 forced outward due to centrifugal force, no contact of the two gears can come about. The tooth head seal, as already mentioned, is thus being built up only when the partial pressure acts on the sealing element 30.

As regards the specific contour, i.e., the shaping of sealing element 30, the following problem points were encountered in conjunction with first practical trials: It was demonstrated that the sharp edges of the mushroom cap of the sealing element 30 are at risk of breaking, and this, in turn, would ultimately result, due to tolerance E in the sealed length becoming increasingly longer (compare "b" in FIG. 2).

To eliminate problems observed relative to the prior art, sealing element 30 was newly designed as follows:

Since at the beginning of the theoretical head seal the suction phase still exists, the maximum sealing length on the sealing element 30 is not needed in the area from the center to the suction side (refer to arrow S). Hence, the mushroom cap of the sealing element 30 was in this area provided with a radius R1;

in the area from the center to the pressure side (refer to arrow D), the sealing effect created by sealing element 30 between pinion 5 and ring gear 6 must always have maximum sealing length. This means that a radius R2 can be realized at the end of the seal, if at the same time the involute length is reduced on the appropriate nonbearing tooth flank F2 (compare Z).

FIG. 2 illustrates the newly designed mushroom cap of the sealing element 30 in detail, in which context it is noted once more that the two radii R1 and R2 on the sealing element engender a dual effect, namely for one, ensuring that the entering will not reduce the sealing length—as with the internal gear pump according to the patent application P 41 40 293.6—but enlarge it (compare "b"), and for another, ensuring that the edges of the mushroom cap will not be sharp-edged and, thus, cannot spall.

In conjunction with experiments of an internal gear pump corresponding to the prior art, ultimately, another point has proved to be problematic. Here, one must base on the fact that the flank F1 of the ring gear that bears in meshing (trailing) must transmit the torque equaling the operating pressure. According to an embodiment illustrated in the prior art, the form-fit fixed stop of the sealing element relative to the profile groove 34 was realized in that the trailing foot part, viewed in the direction of rotation X of ring gear 6, was conically widened and the wall of the profile groove 34 had a complementary design. However, the bearing flank F1 of ring gear 6 was weakened thereby.

According to the present advancement, the fixed stop for the sealing element 30 is realized in conjunction with the nonbearing flank F2, and this new geometry guarantees thereby a strength sufficient for the forces that occur. The tooth cross section on the side of the bearing flank F1, in the area of the profile groove 34 for receiving the sealing element 30, corresponds thus to a beam subject to equal bending stress.

What is claimed is:

1. A sickleless internal hydraulic gear pump, including an internally toothed ring gear, an externally toothed pinion in mesh with said ring gear, a housing rotatably carrying said ring gear and pinion, said housing having a suction port and a pressure port, said ring gear having a plurality of radially extending ports, each of said ring gear teeth and pinion teeth having a tooth head with a flank, the teeth of one of said ring gear and said pinion having a plurality of profile grooves respectively disposed in said tooth heads, said gear pump further including a plurality of sealing elements respectively disposed in said profile grooves, said sealing elements respectively slidably contacting opposing tooth heads of the other of said ring gear teeth and pinion teeth, wherein said gear pump comprises:

each of said profile grooves having an absence of one or more ports extending from said profile groove to said flank of said tooth head; and each of said sealing elements defining a sealing face and including at least one channel extending from said sealing face to a side of said sealing element opposite said sealing face, said channel having open ends disposed at said sealing face and said opposite side, respectively, and otherwise completely enveloped by said sealing element.

2. The internal gear pump of claim 1, wherein said housing has an internal cavity for rotatably carrying said ring gear and said pinion, said internal cavity, ring gear teeth and pinion teeth having an axial width, said internal cavity axial width being at least as wide as said ring gear teeth axial width and said pinion teeth axial width.

3. The internal gear pump of claim 1, wherein each of said sealing elements has a sealing face and a cross-sectionally mushroom-shaped profile, said sealing face corresponding to a top of said mushroom-shaped profile.

4. The internal gear pump of claim 1, wherein said at least one channel comprises at least one bore.

5. The internal gear pump of claim 1, wherein said pinion defines an axial direction and said sealing element has a sealing face with opposite outside edges extending generally parallel to said axial direction, each of said opposite outside edges being rounded.

6. The internal gear pump of claim 5, wherein each said ring gear tooth head and each said pinion tooth head includes a load bearing flank and a non-load bearing flank, said non-load bearing flanks of at least one of said ring gear tooth heads and pinion tooth heads being dimensionally reduced relative to the respective load bearing flank.

7. The internal gear pump of claim 6, wherein each of said respective profile grooves and said sealing elements have a complementary cross-sectional profile, each said profile groove including a fixed stop which is disposed closer to said non-load bearing flank than said load bearing flank.

* * * * *